United States Patent [19]

Larrison et al.

[11] 4,024,793

[45] May 24, 1977

[54] ENERGY ABSORBING DEVICE AND DETENT FOR CONSTANT RECOIL SLIDE

[75] Inventors: Edward R. Larrison; Ray O. Reade, both of Davenport, Iowa

[73] Assignee: The United States of America as represented by the Secretary of the Army, Washington, D.C.

[22] Filed: Oct. 8, 1975

[21] Appl. No.: 620,601

[52] U.S. Cl. ..... 89/135; 89/42 B; 89/155; 89/180; 89/198; 188/1 B

[51] Int. Cl.[2] ..... F41D 11/12

[58] Field of Search ..... 24/115 F, 201 S, 201 TR, 24/230 F, 230 SL; 89/42 B, 180, 198, 135; 188/1 B

[56] References Cited

UNITED STATES PATENTS 3,611,873 10/1971 Ellison ..... 89/180

3,677,135 7/1972 Haug ..... 89/42 B

FOREIGN PATENTS OR APPLICATIONS 1,703,375 12/1971 Germany ..... 89/198

*Primary Examiner*—Stephen C. Bentley

*Attorney, Agent, or Firm*—Nathan Edelberg; Harold H. Card, Jr.; Robert O. Richardson

[57] ABSTRACT

A clamp and wedge attachment to fixed and moving components frictionally engages the components which become disengageable upon application of overriding forces. The wedge has an enlarged detachable loading end which fits between two tines of the clamp which acts as flexure springs. This structure eliminates the slide bounce problem encountered in adapting the M39, 20MM Automatic Revolver Cannon to a constant recoil mode of operation.

5 Claims, 4 Drawing Figures

ENERGY ABSORBING DEVICE AND DETENT FOR CONSTANT RECOIL SLIDE

GOVERNMENT RIGHTS

The invention described herein may be manufactured and/or used by or for the Government for governmental purposes without the payment of any royalty thereon.

BACKGROUND OF THE INVENTION

Generally in firing guns, the larger and more powerful the ammunition, the larger will be the gun. If the gun is mounted on a vehicle, such as a tank, the mountings must be substantial to transmit the recoil forces to the vehicle and to hold the gun on target for the next shot. In the case of a flexible helicopter frame, however, it is desirable that the gun absorb its own recoil force generated when the gun is fired. In this manner the structural vibration on the helicopter carrier, which is excited by pulsating recoil forces, is lessened and does not interfere with the helicopter flying operation or with the aiming of the gun for subsequent firing.

It has been found that if the peak recoil forces of the gun on its mountings can be reduced substantially, larger weapons may be mounted and used on lighter vehicles. With the reduction of extremely high peaks of the recoil forces, helicopters could carry larger guns and could perform as airborne artillery. Moreover, existing weapons could be fired with greater accuracy.

To this end an M39, 20MM Automatic Gun, normally utilized by fighter and bomber aircraft in forward firing fixed mounts, has been adapted for helicopter use by reducing its peak recoil variation of +2,000 lbs. to −2,000 lbs. to a constant recoil force on the order of approximately 475 lbs. This recoil force is substantially constant when the weapon is fired at 600 rounds per minute. More information concerning this problem and its solution may be had with reference to U.S. Pat. No. 3,677,135 issuing July 18, 1972 to Edward J. Haug, Jr. for Machine Gun Having a Firing System Means for Obtaining Substantially Constant and Minimum Recoil Forces.

The M39 automatic gun is a gas operated, belt-fed and electrically fired revolver type weapon. In its original mode of firings a circuit blade assembly was positioned on the operating slide assembly. When the slide assembly had chambered a cartridge and was in battery position, ready for firing, the circuit blade completed an electrical circuit which caused electrical firing of the cartridge.

The electrical firing system may use alternating or direct current source to fire the weapon. The firing system is composed of the harness assembly which is attached to the drum cradle body, firing circuit blade assembly which is attached to the operating slide, and the firing contact pin assembly which is housed in the drum cradle body. The current flows from the plug connector to the contact blades, continuing toward the firing contact pin only if the operating slide is in battery, thereby positioning the firing circuit blade to complete the circuit.

When the M39 automatic gun has been modified for constant recoil operation, such as taught by the Haug patent earlier referred to, there is an additional switch in the circuit that must be closed before the gun will fire. This additional switch closes when the gun forward momentum (after recoil from firing the previous round) equals half of the ammunition impulse. Because of this additional requirement for constant recoil operation, the firing of the gun by closing the circuit with the operating slide blade assembly (denoting the slide to be in battery position) will not necessarily occur. Only when both conditions are met, that is, the slide is in battery position and the gun forward momentum equals half the ammunition impulse, will the gun fire the next round. More broadly, the slide may be in battery position and waiting for any second event to occur to close a second switch to fire the gun. A rate of fire switch actuator may be another example for dual condition firing for which the present invention is adoptable.

It is with this double criteria before firing, that a slide bounce problem is created, and subsequently solved by the present invention. The slide assembly moves to battery position as it chambers a round in the barrel chamber. Thus, relative to the barrel (and the rest of the gun) the slide moves at a certain rate and with a certain mass. At the same time the gun is firing and recoiling, at a different rate and mass. Hence, the slide doesn't stay in battery position for any appreciable length of time but hits the gun chamber and bounces out again. Under the original operating condition the slide switch would close, the gun would fire, and there would be no problem. However, under the constant recoil mode of operation, the second switch also must close and the gun fired while the slide is in battery position or the gun will not fire. If the second switch closes after the slide switch has opened, due to slide bounce, the firing circuit still is not closed.

SUMMARY OF THE PRESENT INVENTION

In accordance with the present invention an energy absorbing device with detent for the slide of the M39, 20 MM automatic cannon has been provided to overcome the slide bounce problem encountered in its constant recoil mode of operation. It consists of a clamp with two tines which provides a gap between its wedge mating surfaces through which a wedge with an enlarged, detachable leading end is forced when the slide moves into battery position. The clamp tines which mate with the wedge are joined to the closed end of the clamp by thinner sections which act as flexure springs. The clamp and wedge are attached to the receiver and slide respectively.

Upon forcing the enlarged end of the wedge through the tines, the thin sections of the clamp are forced apart and stressed as cantilever beams creating positive normal clamping forces and a frictional axial force on the wedge. Upon moving a preset distance through the tines, the enlarged end of the wedge enters the flexure spring opening in the clamp allowing the clamp tines to snap tightly closed on the wedge and maintain positive normal forces on the wedge while the large end serves as a detent.

In this manner the counterrecoil energy of the slide is absorbed as it advances to battery position and much of the slide bounce energy is dissipated by the time the slide battery position has been reached. The large wedge end serving as a detent is the final positive force maintaining the slide in battery position until the next cartridge has been fired and the slide recoils.

DETAILED DESCRIPTION OF ILLUSTRATIVE EMBODIMENT

Figure 1:
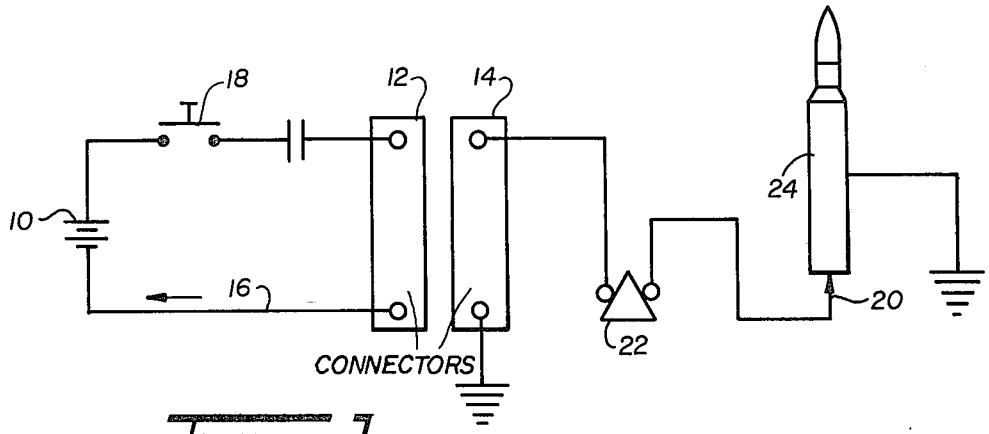
FIG. 1 is a schematic view illustrating the electrical firing system with which the present invention is used.

Reference is now made to FIG. 1 which is a schematic drawing of the electrical firing system which lustrates the need of the present invention. An electrical source 10 may be either AC or DC and is the power ource for firing the gun. It has a plug connector 12 to which a plug connector 14 of the firing circuit is mated. Within the power source circuit 16 is a switch 18 which loses when the forward momentum of the gun on ounterrecoil equals half the ammunition impulse. In ther words, switch 18 closes at the time the gun is at constant recoil condition and is operating in the contant recoil mode, as set forth in the Haug patent earlier eferred to.

Plug 14 connects the cartridge firing contact pin 20 o the power source 10 through a firing circuit contact 2 which is actuated by the operating slide blade assembly, indicating the slide is in battery position and eady for the gun to fire. Cartridge 24 is grounded hrough the gun chamber in which it is positioned.

From the foregoing it can be seen that if switch 18 is ot in the power circuit or it is always closed, the gun iring is controlled solely by the firing circuit contact 22 which actuates firing when the gun slide reaches battery position. In this mode of operation there is no slide ounce problem and there is no need for the present ivention. While it is true that the slide does bounce earwardly after moving forward to battery position, his makes no difference since the firing circuit contact 2 has closed and firing has occurred (on the order of 00 rounds per minute).

The problem solved by the present invention is presented when switch 18 is in the circuit and opens or loses at selected times, such as when the gun is operating in the constant recoil mode. As explained earlier, uch a mode of operation reduces the recoil and permits the gun to be carried on a lighter frame. The veight saving can be converted into extra fuel storage or longer operating range in the case of tanks, for xample. It also permits use of an M39 automatic canon on a helicopter as previously mentioned, for flying rtillary operation. Switch 18 can be closed at other mes and under other conditions, as desired.

In the constant recoil mode switch 18 closes only ery briefly during each cycle of firing and it is essential iat the firing circuit contact 22 be closed at that moient or the gun will not fire. This contact is closed only hen the operating slide is in battery position.

In theory this occurs during counterrecoil of the perating slide and just before the forward momentum f the gun equals half of the ammunition impulse, i.e., hen constant recoil operation occurs and switch 18 loses. However, in practice, when the slide reaches attery position it does so with such force that it ounces rearwardly on the order of one-fourth inch istead of staying in battery position until the cartridge fired and recoil occurs. The problem then becomes iat of keeping the operating slide in battery position ntil switch 18 closes to complete the circuit and fire the gun, and thereafter permit the slide to recoil rearwardly after the firing.

Figure 2:
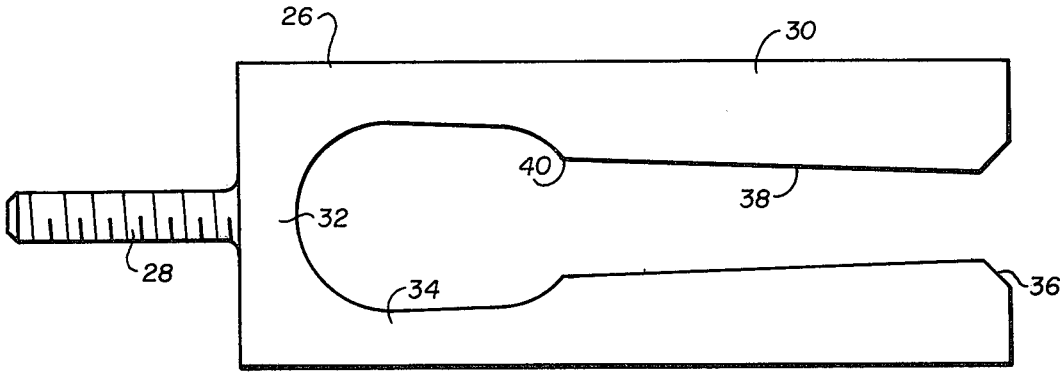
FIG. 2 is a side elevational view of the clamp without ngagement of the wedge.
Figure 3:
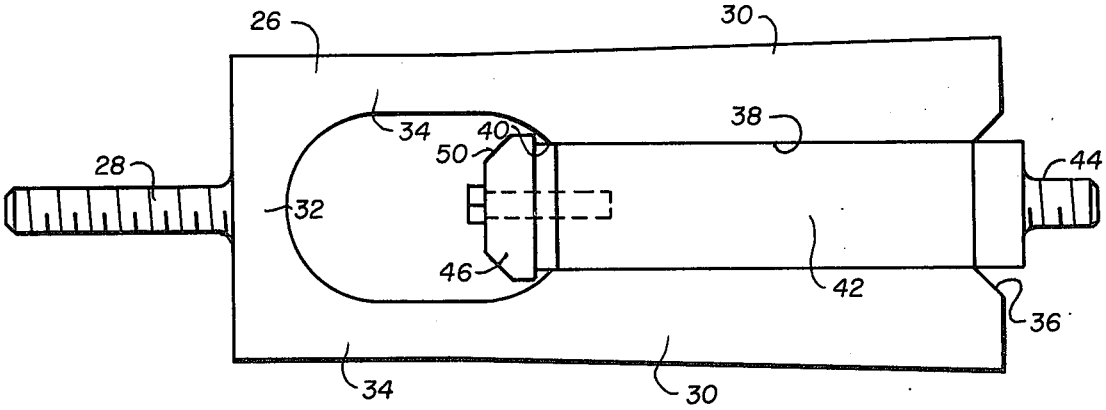
FIG. 3 is a side elevational view of the clamp and vedge in engagement.
Figure 4:
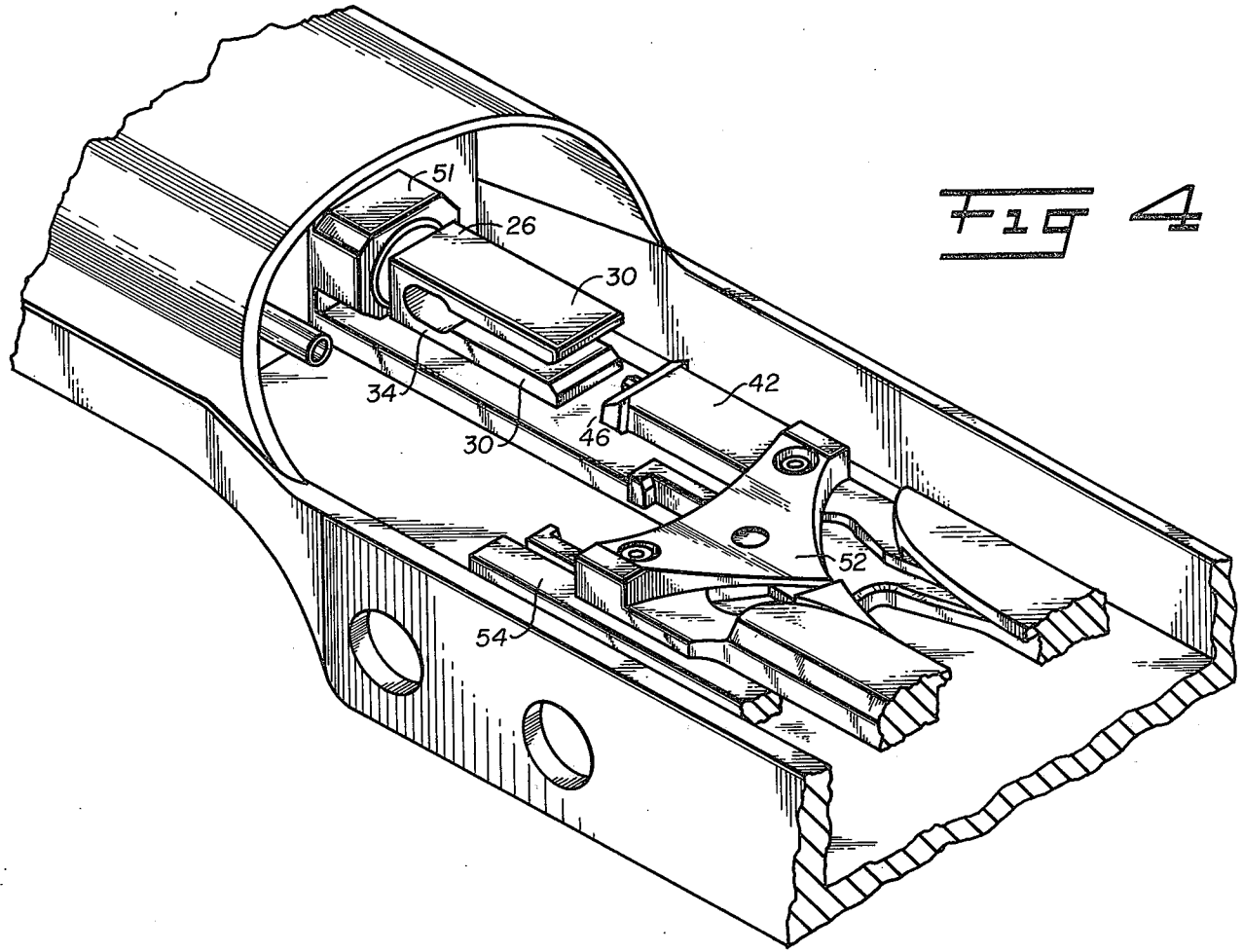
FIG. 4 is a perspective view showing the clamp attached to the gun carrier and the wedge attached to the lide assembly.

The solution to the problem is in the design and use of a clamp and wedge combination shown in FIGS. 2, 3, and 4. Here is shown a clamp 26 with a threaded stem 28 for attachment purposes. This clamp has a pair of spaced apart tines 30 connected to a base 32 through reduced tine portions 34. The tines 30 have inwardly directed sloping surfaces 36 at their ends to receive a wedge between them.

Tines 30 also have tapered inner surfaces 38 that terminate in shoulders 40 adjacent to the tine reduced portions 34. These tapered surfaces permit the insertion of a wedge and the spreading apart of the tines with maximum surface contact such as can be seen in FIG. 3. Here is shown a flat wedge 42 of constant thickness. This wedge has a threaded connecting shaft 44 at one end and an enlarged removable end 46 held by bolts 48 at the other. This end 46 is replaceable since it is subject to wear. This enlarged end 46 has a thickness slightly greater than the spacing between shoulders 40. End 46 has tapered or rounded corners 50 to facilitate its insertion between the tines 30.

Upon forcing the large end 46 of the wedge 42 through the tines 30, the thin sections 34 of the clamp 26 are forced apart and stressed as cantilever beams, creating positive normal clamping forces and a frictional axial force on the wedge. Upon moving a preset distance through the tines, the enlarged end 46 of wedge 42 enters the flexure spring opening defined by reduced portions 34 in the clamp 26, allowing the clamp tines 30 to snap tightly closed on the wedge 42 while the enlarged end 46 serves as a detent against shoulders 40.

In FIG. 4 clamp 26 is shown mounted to the gun receiver 51 and the wedge 42 is mounted to the front of slide 52. As the slide 52 moves forward on slide rails 54 to battery position, wedge 42 passes between the clamp tines 30. End 46 protrudes into the enlarged space between the tine reduced portions 34 where it is held by clamp shoulders 40 until the gun is fired and the slide recoils rearwardly.

While an illustrative embodiment of the present invention has been set forth, obvious modifications will occur to those skilled in the art and it is to be understood that these variations from the embodiment described are to be considered as being within the scope of the present invention as set forth in the appended claims.

What is claimed is:

1. A clamp and wedge attachment between relatively fixed and moving components for releasably maintaining said components in fixed relationship until subjected to overriding forces, said relatively fixed and moving components being a gun receiver and an operating slide for chambering cartridges, said clamp having a pair of spaced tines between which said wedge frictionally moves as said slide moves forwardly to battery position, said tines having inner tapered surfaces for continuously contacting said wedge when said wedge is inserted therebetween, said clamp having a base to which said tines are connected, said tines having a reduced portion adjacent said base forming a flexure spring opening and allowing said tines to snap tightly closed on said wedge.

2. A clamp and wedge attachment as set forth in claim 1 wherein said wedge is of a constant thickness, said wedge having an enlarged end fitting between said tine reduced portions when said slide is in battery position.

3. A clamp and wedge attachment as set forth in claim 2 wherein said tines have shoulders thereon engagable by said enlarged end to prevent dislodgement of said wedge from said clamp tines until firing of said gun upon which said attachment is mounted.

4. A clamp and wedge attachment as set forth in claim 1 wherein said tines have inclined surfaces on the ends thereof and said wedge has an end surface engagable therebetween upon insertion of said wedge between said tines.

5. A clamp and wedge attachment as set forth in claim 1 wherein said slide closes an electrical switch in the gun firing circuit when said slide is in battery position, said attachment maintaining said slide in battery position until said gun is fired.

* * * * *